US010818273B1

(12) United States Patent
Richard

(10) Patent No.: US 10,818,273 B1
(45) Date of Patent: Oct. 27, 2020

(54) MULTI TONE, ATTACHABLE, AND CONTROLLABLE GUITAR PICK

(71) Applicant: Gary Richard, Danvers, MA (US)

(72) Inventor: Gary Richard, Danvers, MA (US)

( * ) Notice: Subject to any disclaimer, the term of this patent is extended or adjusted under 35 U.S.C. 154(b) by 0 days.

(21) Appl. No.: 16/789,405

(22) Filed: Feb. 12, 2020

Related U.S. Application Data

(63) Continuation of application No. 16/389,985, filed on Apr. 21, 2019, now abandoned.

(51) Int. Cl.
*G10D 3/173* (2020.01)

(52) U.S. Cl.
CPC ..... *G10D 3/173* (2020.02)

(58) Field of Classification Search
CPC ..... G10D 3/173
See application file for complete search history.

(56) References Cited

U.S. PATENT DOCUMENTS 5,587,542 A * 12/1996 Everly ..... G10D 3/173
84/322

* cited by examiner

*Primary Examiner* — Kimberly R Lockett

(57) ABSTRACT

The present invention is a guitar pick with a slot or channel for attaching the pick to guitars, guitar straps, clothing buttons, beads, and other accommodations and also the slot being able to control the orientation and retention of the instrument pick. The slot allows for attachments to be made to the picks, for enhanced gripping, for tonal changes, for offsetting finger dulling effects, and for stacking/adjoining for a variety of effects.

14 Claims, 10 Drawing Sheets

MULTI TONE, ATTACHABLE, AND CONTROLLABLE GUITAR PICK

This application is a Continuation-In-Part of and claims priority to U.S. Non-Provisional application Ser. No. 16/389,985 filed on 21 Apr. 2019, the entire disclosure of which is incorporated by reference.

BACKGROUND OF THE INVENTION

Field of the Invention

The present invention is in the field of guitar accessories. More specifically, the present invention is a multi-tone, attachable, controllable guitar pick.

Background of the Invention

The present invention is a guitar pick for attaching to guitars, guitar straps, clothing buttons, beads, and other accommodations, and also being able to control the orientation, and retention of the instrument pick, along with making many different sounds, and do so within the standard teardrop guitar pick footprint.

The present invention is a functional, 3 channel, cutout design, on a guitar pick, which allows the pick to be securely snap attached to a 6 mm (+−) accommodation such as a guitar tuning post, or guitar strap, bead, keychain, etc., without the guitar pick being susceptible to unintentional dislodging, or disconnection. The present invention also provides important gripping, which helps to prevent picks from being dropped, and also improves position stability.

The present invention may also be attached to a clothing button, or other device, which may be tilted at an angle, and slid into the 3-channel invention, and then snap locked into place, without the risk of random movement dislodging the guitar pick. For removal, the button, or other device, can be re-tilted and easily slid out for use. The ability to readily attach a guitar pick to a clothing button, or other accommodation, allows a player to always have guitar picks wherever he/she goes. This also dramatically increases the market size, as non-players get to adorn their clothing with guitar picks of their favorite bands, designs, concerts. Performers will realize a dramatic increase in their pick sales, due to the ability to wear these on fan clothing, purses, backpacks, etc. Attaching to a button, requires a center channel, which allows the button thread to travel ⅛"+/− after insertion, with locking prongs located ¼" below the center channel high point. Once the pick is snapped onto the button, the button settles into a more central position, covering the lower locking prongs, which are now positioned under the lower quadrants of the button, and the upper prongs are positioned under the upper quadrants of the button, giving locking support on all four quadrants. The amount of material removed to achieve this complexity, has to be minimized as not to greatly compromise the structural stability of the pick.

Guitarists often lament that they do not have an essential tool handy, a guitar pick, which is necessary to properly play the instrument, for most styles of music. Guitar picks are small, very thin, and slippery, and therefore difficult to always have accessible as they get misplaced, and lost very easily. Guitars, amplifiers, and other musical equipment do not provide for making guitar picks readily available. By relative comparison, several stringed instruments need a bow, as a saxophone player needs a reed, and an artist needs a paintbrush, a guitarist needs a pick, unless the guitarist ascribes to relatively smaller musical genres, which utilize finger picking style play. Though the need is great, guitar picks are so often an elusive element, missing in action. The present invention, makes a guitar pick readily available by being able to pre-mount them on guitars, guitar straps, clothing buttons, and other such accommodations. The amount of pick material removed to create the invention is minimal, and therefore structural integrity of the pick is maintained.

Another benefit of the present invention is in making the guitar pick easier to maintain gripping orientation on each axis, therefore gaining greater stability, and more consistent alignment when playing the guitar strings. Most guitar picks are small, thin, and typically smooth, which makes them prone to unwanted movement, inconsistent orientation, misalignment, and instability. The present invention allows true gripping, and alignment stability, which requires equal length stability, perpendicular to the strings, and parallel to the strings. In the present invention the perpendicular fields 60 and 68 are both 2⁄16" in length, the perpendicular fields 62 and 64 combined equal 5⁄16" in length, which adds up to 9⁄16" of "Y" axis length. In the present invention the parallel to the strings "X" axis, is also 9⁄16" in length, which achieves the requisite stability parity, for all four major periphery features, of the invention Equal perpendicularity, and parallelism, is achieved for the 351 tip, the jazz tip, the multi-string tips, and for the graduated multi-tooth tips.

Another benefit of the present invention is for the improved retentive gripping, minimizing picks being dropped during performance. Dropping picks during performing/playing, is a reality of life, when playing a guitar. As previously mentioned, guitar picks are small, thin, and typically smooth, which makes them prone to slipping out of the player's fingers, which is very disruptive to the performance. There have been many textured guitar picks designed, with enhanced gripping surfaces, to mitigate the slippage factor. The present invention greatly reduces the risk of the pick being dropped, using finger to finger contact. Jazz picks are especially difficult to grasp, the invention includes the Jazz tip, with added benefit of greater gripping area.

Another benefit of the present invention, is tethering. The pick can be tethered to lanyards, or other devices, which gives the guitarist many other options for transport, and accessibility.

Another benefit of the present invention also allows other add-ons, and attachments, such as grommets, elastics, or novelties, which can aid in the performance, and enhance the previously listed benefits. Also, inserts can adjoin multiple picks, and add-ons, creating multiple effects, which may also offset the dulling tonal effect, which fingers can have on guitar picks.

Another benefit of the present invention is in creating greater flexure, if desired. By rotating the pick, or by changing the finger position, or by changing the strength of the grip, the present invention creates other dynamics, which may be desirable when performing.

Another benefit of present the invention is being able to mount it to a beverage closer device key ring mount, creating a pivotal device. Another benefit is being able to "sandwich" the pick between other materials, which can soften, or accentuate the tonal attributes of the guitar pick. Some players will use a metal guitar pick, for the resulting crisp tonal effect, but metal picks are potentially damaging to strings and to the instrument. Sandwiching the pick between two hard surfaces, which could include magnets, a similar tonal effect can be created, without the deleterious effects.

Another benefit, is the ability to use a retentive structure, which utilizes the mating innovation, in order to immobilize any movement of the pick.

The guitar pick, as we know it today, or plectrum as it is called in the UK, was made from tortoise shell in the 19th century. Prior to that, feather quills were the most common material for picking guitars, and related instruments. The industry states, that combined manufacturers produce hundreds of millions of picks every year, but the majority are produced by three major manufacturers, Dunlop, Fender, and Clayton. The average customized production for touring bands, would be 7,000, as many are thrown out to the fans during performances. Pick collecting is very popular, there are web sites and publications dedicated to the subject. Making the picks attachable, allows for them to be displayed on clothing, jewelry, and many more accommodations.

The Four Pick Characteristics. Players will often switch styles of picks, depending on the style of music. Shape: The overall shape has less effect on tone, it has more to do with comfort, and handling. The vast majority of picks fall into the standard teardrop shapes. That being said, the tip, or point does have a clear effect on the playability, and tone. Many believe that that for fast playing, a highly pointed pick is the best shape for speed, but they tend to wear down more quickly.

Thickness: Affects tone, and dictates how much give the pick has, as it pulls across the string during the attack. Certain styles of playing are even rooted in a certain thickness of pick. Lighter picks provide a brighter tone, but flex more, and break more easily, they tend to be used more for strumming. Single note runs will not have the same power, or resonance, on acoustic guitars, but can be effective on electric guitars. Medium picks, the most common used, produce a more even tone, and have good durability, and good sound quality. These are the general choice for soft rock, and country music. Heavier picks provide a deeper, more aggressive tone, they are more durable, and are the thickness preferred by Jazz players who use heavy gauge strings. Because these are thicker, harder and often smaller, and less flexible, they are more difficult to grasp, keep in control, they tend to slip more. Extra Light (less than 0.44 mm) Light (approx. 0.44 to 0.69 mm) Medium (approx. 0.70 to 0.84 mm) Heavy (approx. 0.85 to 1.50 mm)

Extra Heavy (Greater than 1.50 mm)

Materials: Plastic, metal, bone, horn, stone, wood, even refashioned coins. Current materials are mostly celluloid, Delrin, Nylon, Tortex, or Acetal. Material tends to less effect on electric guitars, but does more so on acoustic guitars, as the interplay of contact of the string and pick is more magnified. Harder materials tend to have a brighter attack. Nylon and softer materials have a slower attack.

Texture: Picks generally are thin and smooth, making them slippery, especially when sweating. Some picks provide a textured surface, or a high friction coating to aid

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION OF ILLUSTRATIVE EMBODIMENTS

Various aspects of the illustrative embodiments will be described using terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Various operations will be described as multiple discrete operations, in turn, in a manner that is most helpful in understanding the present invention, however the order of description should not be construed as to imply that these operations are necessarily order dependent. In particular, these operations need not be performed in the order of presentation.

The phrase "in one embodiment" is used repeatedly. The phrase generally does not refer to the same embodiment, however, it may. The terms "comprising", "having" and "including" are synonymous, unless the context dictates otherwise.

Figure 1:
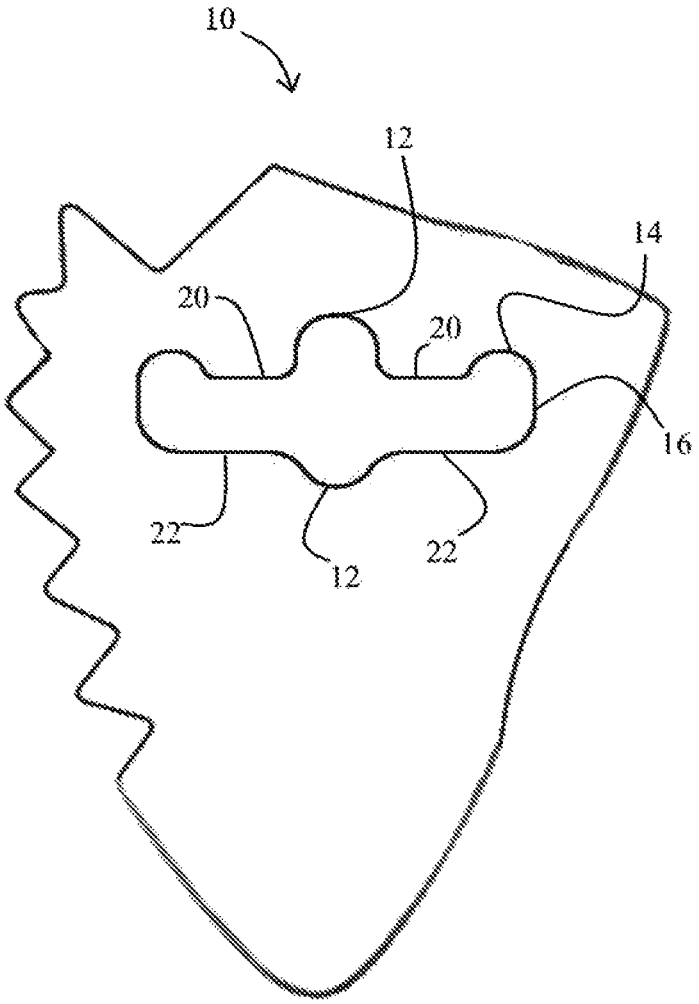
FIG. 1 illustrates a multi tone, attachable, controllable guitar pick, in accordance with one embodiment of the present invention.

Referring now to FIG. 1, illustrated is an attachable, controllable guitar pick, in accordance with one embodiment of the present invention. In FIG. 1, illustrated is a attachable, controllable guitar pick 10 shown are center channels 12 that may be for button threads or a tuning post. Shown are at least one outer channel 14 that may be for raised button edges. Shown is at least one wide slot 16 for a button to be angled into. Shown are at least one locking prong 20. Shown is at least one locking edge 22.

Figure 2A:
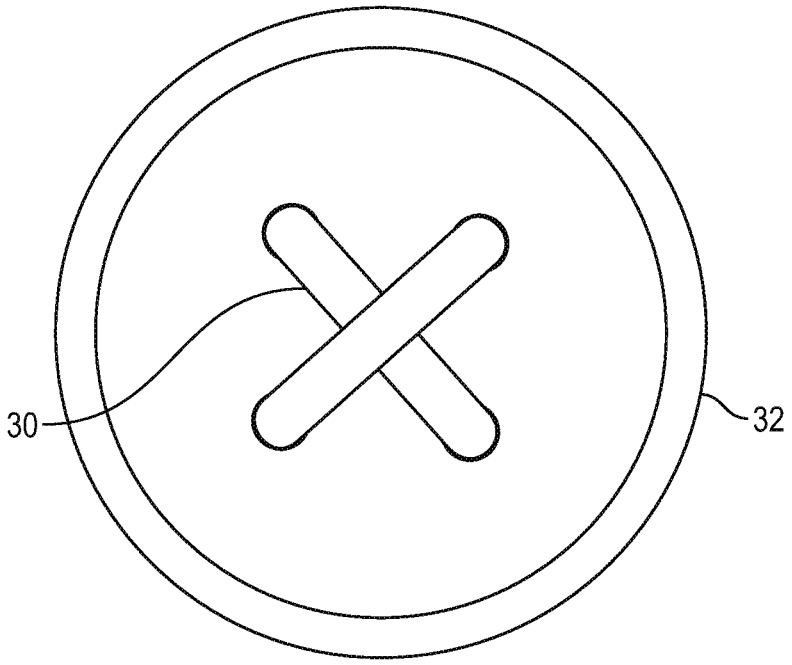
FIG. 2A illustrates a front view of a button, in accordance with one embodiment of the present invention.
Figure 2B:
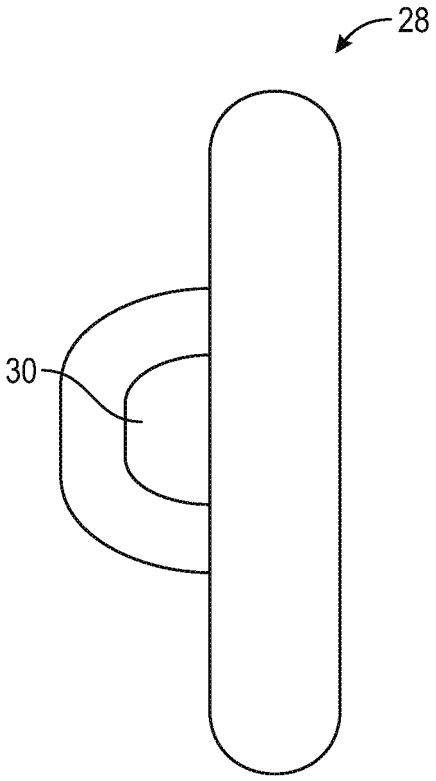
FIG. 2B illustrates side view of a button, in accordance with one embodiment of the present invention.
Figure 2C:
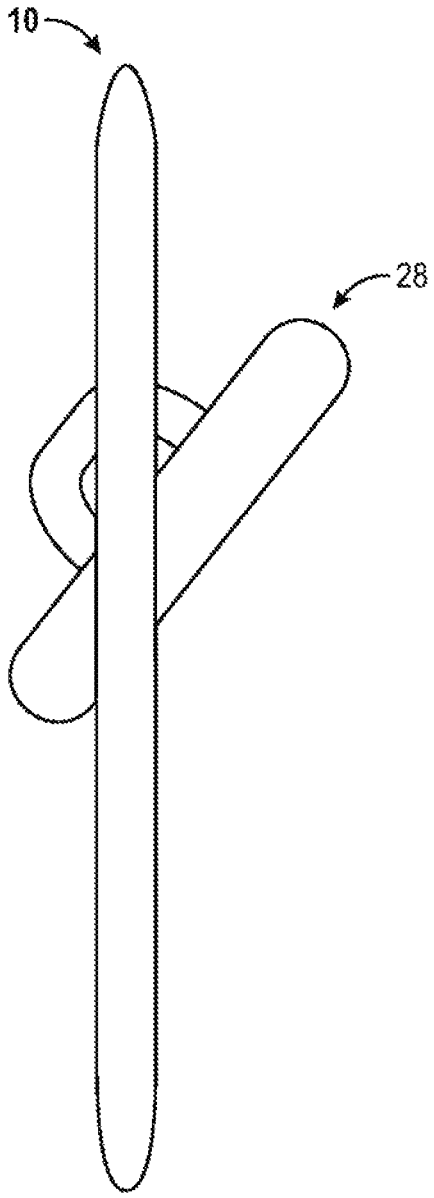
FIG. 2C illustrates a multi tone, attachable, controllable guitar pick, in accordance with one embodiment of the present invention.
Figure 2D:
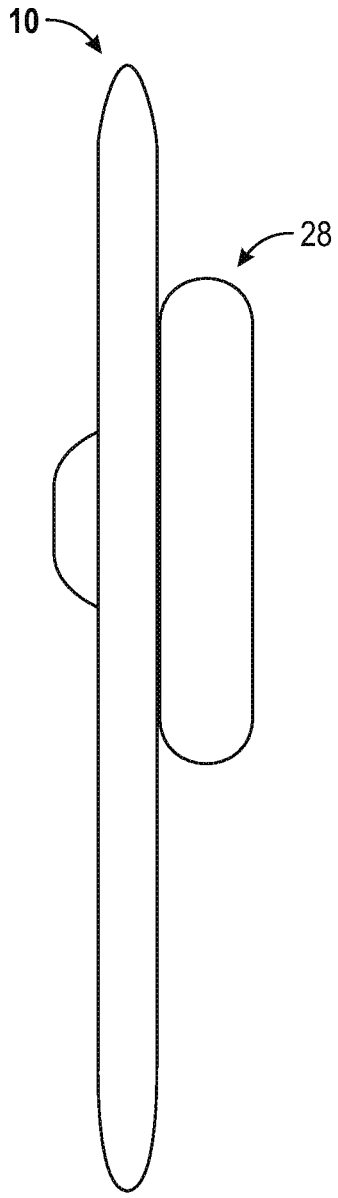
FIG. 2D illustrates a multi tone, attachable, controllable guitar pick, in accordance with one embodiment of the present invention.
Figure 2E:
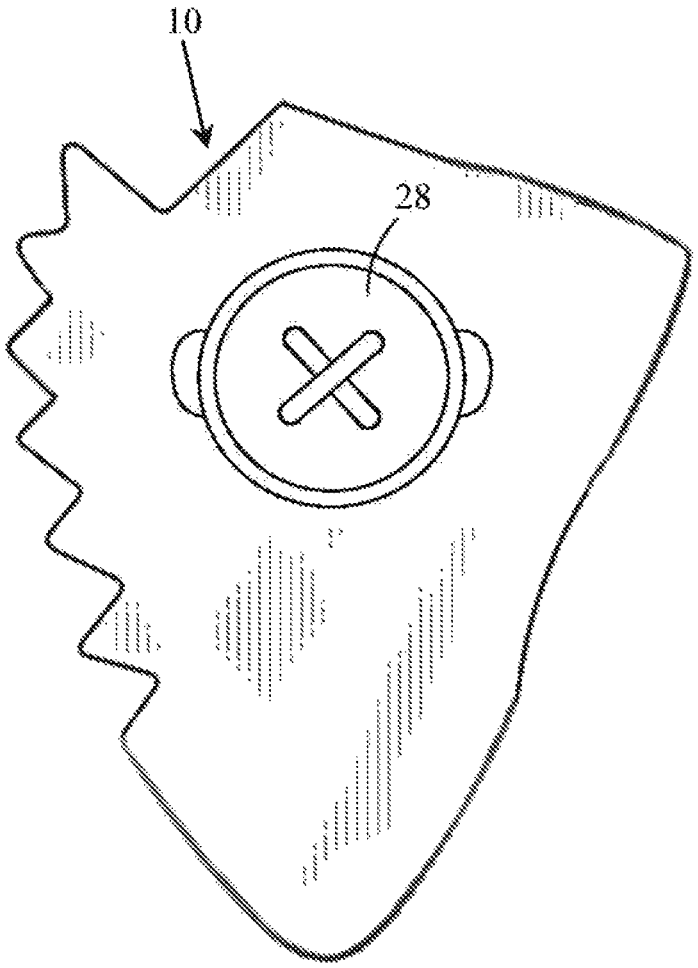
FIG. 2E illustrates a multi tone, attachable, controllable guitar pick, in accordance with one embodiment of the present invention.
Figure 3:
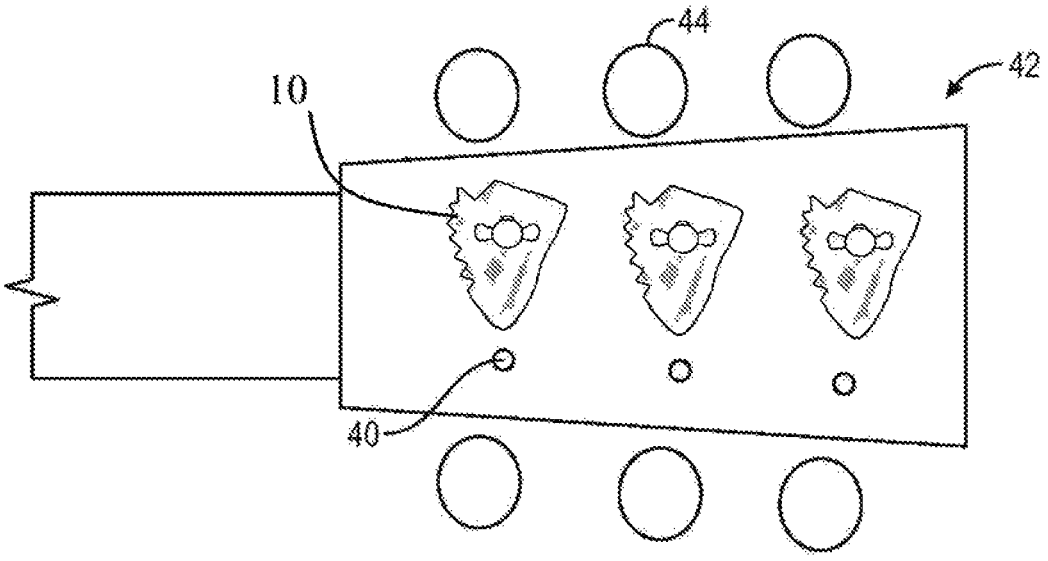
FIG. 3 illustrates a multi tone, attachable, controllable guitar pick, in accordance with one embodiment of the present invention.
Figure 4:
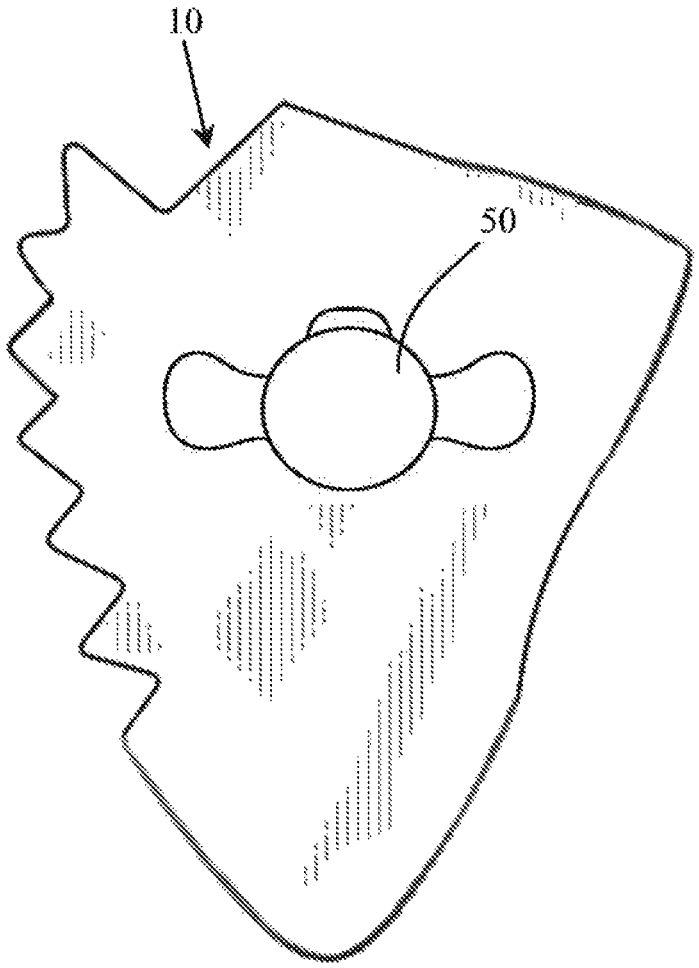
FIG. 4 illustrates a multi tone, attachable, controllable guitar pick, in accordance with one embodiment of the present invention.

Referring now to FIG. 2A, illustrated is a front view of a button 28, in accordance with one embodiment of the present invention. Button 28 has a button thread 30 with raised button edge 32 circling the button thread 30. Referring now to FIG. 2B, illustrated is a side view of a button 28, in accordance with one embodiment of the present invention. Shown is button 28 with a button thread 30. Referring now to FIG. 2C, illustrated is a side view of a button 28 and attachable controllable guitar pick 10 in accordance with one embodiment of the present invention. Shown is button 28 angled into a wide slot 16. Shown is button edge 32 though channel 14. Shown is button thread 30 through button thread channel 12. Referring now to FIG. 2D, illustrated is a side view of a button 28 and attachable controllable guitar pick 10 in accordance with one embodiment of the present invention. Shown is button 28 installed onto attachable controllable guitar pick 10 and locked into place by locking prongs 20 and locking edges 22. Referring now to FIG. 2E, illustrated is a font view of a button 28 and attachable controllable guitar pick 10 in accordance with one embodiment of the present invention. Shown is button 28 installed onto attachable controllable guitar pick 10. Referring now to FIG. 3, illustrated is an attachable controllable guitar pick 10, in accordance with one embodiment of the present invention. In FIG. 3, illustrated is a attachable controllable guitar pick 10 installed on a tuning post 40. Shown are guitar head 42 and tuning key handle 44. Referring now to FIG. 4, illustrated is an attachable controllable guitar pick 10, in accordance with one embodiment of the present invention. In FIG. 4, illustrated is a attachable controllable guitar pick 10 installed on a tuning post 50.

Figure 5:
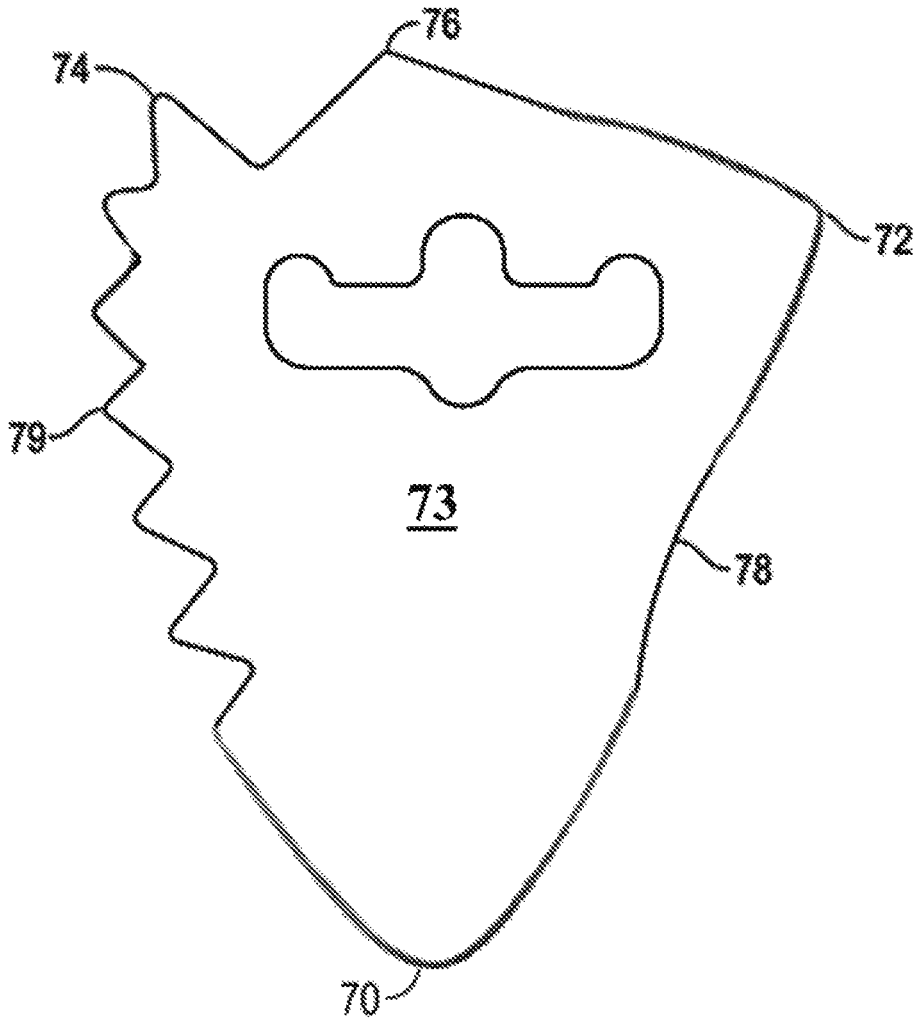
FIG. 5 illustrates a multi tone, attachable, controllable guitar pick, in accordance with one embodiment of the present invention.

Referring now to FIG. 5, illustrated is an attack effect guitar pick, in accordance with one embodiment of the present invention. In FIG. 5 illustrated is an attack effect guitar pick 73. Shown are broad tip 76 and focused tip 74 located near the top of attack effect guitar pick 73 broad tip 76 and focused tip 74 may be combined to make a twelve string attach effect. A standard 351 style tip 70 is located at a bottom of attack effect guitar pick 73. A graduated multi tooth 79 is for a twelve-string strum effect and is located on the same side as the focused tip 74. The side the opposite graduated multi tooth 79 is jazz tip 72 located above indention for finger grip 78.

Figure 6:
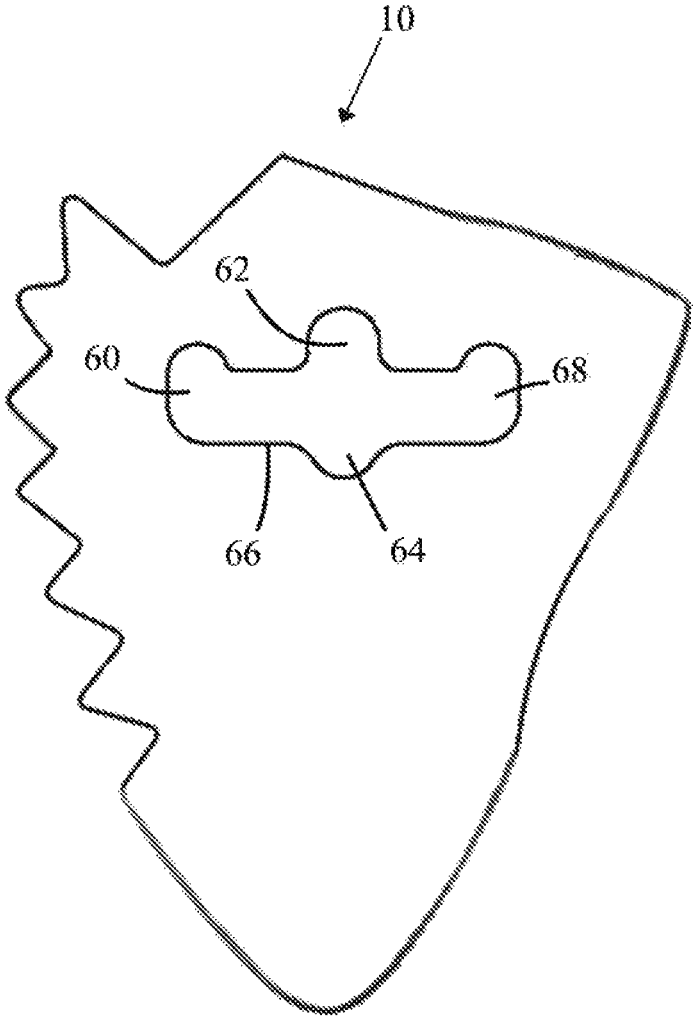
FIG. 6 illustrates a multi tone, attachable, controllable guitar pick, in accordance with one embodiment of the present invention.

Referring now to FIG. 6, illustrated is a controllable guitar pick, in accordance with one embodiment of the present invention. In FIG. 6, illustrated is a controllable guitar pick 10 shown are two stable identical fields symmetrical about a Y axis the two stable identical fields symmetrical about a Y axis are left stable field 60 and right stable field 68. Shown is an open field 66 for finger to finger contact and wide stability field 62 on the top of open field 66 and a bottom field 64 opposite the wide stability field 62 about an X axis.

While the present invention has been related in terms of the foregoing embodiments those skilled in the art will recognize that the invention is not limited to the embodiments described. The present invention may be practiced with modification and alteration within the spirit and scope of the appended claims. Thus, the description is to be regarded as illustrative instead of restrictive on the present invention

What is claimed is:

1. A pick comprising:

a broad tip and a focused tip located near a top of the pick the broad tip and the focused tip combine to make a multi-string attack effect, a standard style tip is located at a bottom of the pick, a graduated multi-tooth for a crescendo or diminuendo effect string strum effect is located on a same side as the focused tip, on a side opposite the graduated multi-tooth is a jazz tip located above an indention for finger grip, two center channels to secure the pick to a holder at least one outer channel at least one wide slot is shaped by at least one locking prong and at least one locking edge, an open field in the pick that allows finger to finger contact for controllability and a pathway for sweat to exit having a left stable field and a right stable field are identical and symmetrical about a Y axis, a wide stability field on a top of the open field and a bottom field that is opposite the wide stability field maximizes X axis and Y axis stability in a 1:1 ratio of X to Y axis.

2. The pick of claim 1 wherein the multi-string attack effect is a twelve-string attack effect.

3. The pick of claim 1 wherein the standard style tip is standard 351 style tip.

4. The pick of claim 1 wherein the crescendo or diminuendo effect string strum effect is a twelve-string strum effect.

5. The pick of claim 1 wherein the holder is a tuning post.

6. The pick of claim 1 wherein the holder is a button.

7. A pick comprising:

a broad tip and a focused tip located near a top of the pick the broad tip and the focused tip-combine to make a twelve-string attack effect, a standard 351 style tip is located at a bottom of the pick, a graduated multi-tooth for a twelve-string strum crescendo or diminuendo effect is located on a same side as the focused tip, a side the opposite the graduated multi-tooth is a jazz tip located above an indention for finger grip, two center channels in the pick to secure the pick to a holder with at least one outer channel, at least one wide slot is shaped by at least one locking prong and at least one locking edge, an open field that allows a finger to finger contact for controllability and a pathway for sweat to exit in the pick has a left stable field and a right stable field, the left stable field and right stable field having identical fields symmetrical about a Y axis, a wide stability field on a top of the open field and a bottom field opposite the wide stability field about an X axis the open field of the pick maximizes X axis and Y axis stability in a 1:1 ratio X to Y axis.

8. The pick of claim 7 wherein the holder is a tuning post.

9. The pick of claim 7 wherein the holder is a button.

10. A method for creating new sounds by a player using a pick, controlling the pick and attaching the pick comprising:

gripping by the player the pick at an indention for finger grip;

making a multi-string attack effect with a broad tip and a focused tip in combination the broad tip and the focused tip located near a top of the pick and making a crescendo or diminuendo effect string strum effect with a graduated multi-tooth located on a same side as the focused tip;

controlling the pick by the player having finger to finger contact by an open field in the pick; and attaching the pick to a holder by two center channels, at least one outer channel at least one wide slot the at least one wide slot is shaped by at least one locking prong and at least one locking edge.

11. The method of claim 10 wherein the multi-string attack effect is a twelve-string attack effect.

12. The method of claim 10 wherein the string strum effect is a crescendo or diminuendo effect twelve-string strum effect.

13. The pick of claim 10 wherein the holder is a tuning post.

14. The pick of claim 10 wherein the holder is a button.

* * * * *